US009957716B2

(12) United States Patent
Atchley

(10) Patent No.: US 9,957,716 B2
(45) **Date of Patent: *May 1, 2018**

(54) ROOF RIDGE COVER

(71) Applicant: KWIK RIDGE, INC., Yorba Linda, CA (US)

(72) Inventor: Mitch Atchley, Yorba Linda, CA (US)

(73) Assignee: KWIK RIDGE, INC., Yorba Linda, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/949,698

(22) Filed: Nov. 23, 2015

(65) Prior Publication Data

US 2016/0076251 A1 Mar. 17, 2016

Related U.S. Application Data

(63) Continuation of application No. 13/660,926, filed on Oct. 25, 2012, now Pat. No. 9,194,127, which is a continuation-in-part of application No. 29/385,747, filed on Feb. 18, 2011, now Pat. No. Des. 66,989.

(60) Provisional application No. 61/552,084, filed on Oct. 27, 2011.

(51) Int. Cl.

| | |
|---|---|
| ***E04D 1/30*** | (2006.01) |
| ***E04D 1/34*** | (2006.01) |
| ***E04D 13/17*** | (2006.01) |
| ***E04D 1/26*** | (2006.01) |
| *E04D 1/00* | (2006.01) |

(52) U.S. Cl.

CPC ..... *E04D 1/30* (2013.01); *E04D 1/265* (2013.01); *E04D 1/3402* (2013.01); *E04D 13/174* (2013.01); *E04D 2001/005* (2013.01); *E04D 2001/305* (2013.01)

(58) Field of Classification Search

CPC ... E04D 1/30; E04D 1/3402; E04D 2001/305; E04D 3/362; F24F 7/02

See application file for complete search history.

(56) References Cited

U.S. PATENT DOCUMENTS

| | | | | |
|---|---|---|---|---|
| 1,470,054 | A | 10/1923 | Broughton | |
| 1,653,847 | A | 12/1927 | Greenstreet | |
| 1,861,998 | A | 6/1932 | Bennett | |
| 1,963,583 | A | 6/1934 | Jenkins | |
| 2,160,642 | A | 5/1939 | Bumpas et al. | |
| 2,230,922 | A * | 2/1941 | Young | E04D 1/30 52/275 |

(Continued)

*Primary Examiner* — Ryan D Kwiecinski

(74) *Attorney, Agent, or Firm* — R. Reams Goodloe, Jr.

(57) ABSTRACT

Improvements in a roof ridge cover formed to give the appearance of multiple shingles. The roof ridge cover is fabricated with bend radius to ensure that the elongated base material is not stretched beyond the yield point of the material where it can rupture or split. The edges wrap around existing roof tiles to cover any damaged tiles and provide sufficient clearance of adjacent or abutting ridge covers. The cover is stone coated to provide similar appearance to the roof surface. The stone coatings provide surface protection, wear resistance and provide a gripping surface for installers or others that may walk on the roof surface. Optional venting material may be used under the cover to allow air to vent from the attic thereby allowing the attic to breath, but the vent must also be sufficiently dense enough to prevent insects and bugs from passing through the vent material.

17 Claims, 4 Drawing Sheets

(56) References Cited

U.S. PATENT DOCUMENTS 2,255,247 A * 9/1941 Gabriel ..... E04D 1/30 52/278
2,360,052 A * 10/1944 Fuller ..... E04F 19/024 52/276
2,386,338 A * 10/1945 Norrid ..... E04F 19/024 428/189
2,725,832 A 12/1955 Huntington
3,073,235 A 1/1963 Smith et al.
3,114,218 A 12/1963 Macquere
3,164,929 A * 1/1965 Boddie ..... E04D 3/362 52/409
3,731,438 A 5/1973 Kough
3,760,546 A 9/1973 Martin et al.
3,953,946 A 5/1976 Peters et al.
4,015,374 A * 4/1977 Epstein ..... E04D 1/36 52/278
4,015,391 A 4/1977 Epstein et al.
4,024,685 A 5/1977 Aarons
4,322,924 A 4/1982 Cooper
4,400,217 A * 8/1983 Kober ..... C04B 18/28 106/611
4,554,862 A 11/1985 Wolfert
4,676,147 A * 6/1987 Mankowski ..... E04D 13/174 454/365
4,685,265 A 8/1987 Cooper
4,788,801 A 12/1988 Jones
5,295,340 A * 3/1994 Collins ..... E04D 1/30 52/276
5,304,095 A * 4/1994 Morris ..... E04D 13/174 454/365
5,352,154 A * 10/1994 Rotter ..... E04D 13/174 454/365
5,469,680 A * 11/1995 Hunt ..... E04D 1/18 52/520
5,561,953 A * 10/1996 Rotter ..... E04D 3/30 454/365
5,613,337 A * 3/1997 Plath ..... E04D 1/18 52/519
5,636,490 A 6/1997 Stocksieker
5,881,501 A 3/1999 Guffey
6,351,913 B1 * 3/2002 Freiborg ..... E04D 1/30 52/276
8,245,482 B2 * 8/2012 Grubka ..... E04D 1/20 454/365
2001/0032421 A1 * 10/2001 Rotter ..... E04D 13/174 52/198
2002/0095882 A1 7/2002 Rotter
2004/0206012 A1 * 10/2004 Pressutti ..... E04D 1/30 52/57
2005/0055902 A1 * 3/2005 Pressutti ..... E04D 1/26 52/198
2010/0218433 A1 * 9/2010 Quaranta ..... E04D 1/30 52/57
2011/0214378 A1 * 9/2011 Grubka ..... E04D 1/30 52/553
2012/0096782 A1 * 4/2012 Railkar ..... E04D 13/174 52/198
2014/0202093 A1 * 7/2014 Knighton ..... E04D 13/174 52/198

* cited by examiner

ROOF RIDGE COVER

CROSS REFERENCE TO RELATED APPLICATION

This application is a continuation of co-pending U.S. patent application Ser. No. 13/660,926, filed on Oct. 25, 2012, now U.S. Pat. No. 9,194,127 B2 issued on Nov. 24, 2015, which claimed priority from U.S. provisional patent application Ser. No. 61/552,084 filed Oct. 27, 2011, the entire contents of each of which are hereby expressly incorporated herein by this reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a roofing ridge cover. More particularly, an elongated formed roof ridge that covers multiple existing roof ridge tiles is provided, which makes installation more efficient. The ridge cover provides coverage for a plurality of shingles and wraps at least partially around the shingles to prevent leakage. The ridge cover is formed from a metal base that is stone coated to match existing shingles.

Description of Related Art Including Information Disclosed Under 37 CFR 1.97 and 1.98

The ridge of a roof is one area of a roof that can deteriorate the fastest. This area of a roof is usually subjected to the full sunlight, rain and wind. All of these factors can significantly shorten the life of the ridge cap. A typical ridge cap is fabricated from several layers of roofing felt that are bonded together and then covered with small sand, stones or gravel. The ridge cap area is one of the first parts of a roof from which water can enter into a house. Installing or replacing the ridge cap with a metal cap with prior art devices often results in a significantly different appearance from the surrounding roof material. Some solutions have been to install individual bent shingles resulting in the existence of openings around each shingle and significant labor to install the ridge cover. Several products have been developed and patents have been filed and issued on products that try to solve this problem. Exemplary examples of patents covering these products are disclosed herein.

U.S. Pat. No. 6,725,609 that issued on Apr. 27, 2004 to Mark Freiborg et al. and U.S. Pat. App. Pub. No. 2010/0275542 both disclose ridge or hip covers that simulate a single shingle. They are both formed from a flat blank that is formed along the edges and then bent in the middle to simulate the ridge or hip. Because of the simple bends provided the parts can be slightly re-bent to accommodate varied angular ridges or hips. The part described in these documents is not metal and therefore not painted, and thus does not have rust protection. These parts are then simply rust protected and or painted to match the color of the roof without any additional coatings. The parts described in these documents only cover a single shingle, have limited wrap to cover existing shingles. Further, such parts are embedded in the mat with asphalt and are not coated to simulate stone coated shingles.

U.S. Pat. App Publication Number 2006/0154597 was published on Jul. 13, 2006 and issued as U.S. Pat. No. 7,422,520 on Sep. 9, 2008 to Michael S. Coulton et al. and discloses an integrated vent that is bonded or captured under the top shingle material. The vent material extends essentially across the full width of the shingle where it can interfere with material or obstructions that extend from the base roof or ridge. The device disclosed in this patent does not allow for coverage over shingled roofs where the roof ridge is stepped. Further, that patent does not disclose a stepped shingle or shingles. The disclosure of that patent further requires the rolled material to be covered in the field when it is being installed.

U.S. Pat. No. 4,015,374 issued on Apr. 5, 1977 to George Epstein et al., discloses an angled cap member for simulated cedar shake construction. The cap member is formed from a flat sheet of material and requires an elevated spacer that raises the cap member above the roof. The cap member is then screwed or bonded to the elevated member. The flat sheet of metal material is embossed to form simulated grain. This patent does not disclose the use of sand, stone or gravel to simulate a shingle roof. Also, the cap member disclosed does not have rounded reliefs that allow the cap to wrap around existing shingles.

U.S. Pat. No. 7,108,495 issued on. Sep. 19, 2006 to Thomas Gilbert et al., discloses an apparatus for continuous forming shaped polymeric articles. The polymeric articles simulate the appearance of shake shingles arranged in rows. After the polymeric articles are formed they are surface treated to improve the wearability of the surface. The disclosure of this patent is directed to a method for creating a particular appearance of shingles. The appearance is not stone coated nor is it useful for the roof ridge over shingles.

It would be desirable to provide a formed ridge cap where the cap is formed with sufficient fillets and rounds to prevent ripping of the shingle material. The ridge cap should provide coverage for multiple shingles. Further, it would be desirable that a new formed ridge cap be stone coated to simulate the appearance of a shingle ridge cap. These features are disclosed in this document herein.

BRIEF SUMMARY OF THE INVENTION

It is an object of the invention to provide a roof ridge cover formed to give the appearance of multiple shingles. Fabricating the roof ridge with multiple panels reduces the number of roof ridge covers that must be installed. This provides spacing of roof covers consistent with the spacing of the shingles below, and makes the ridge roof more secure, by reducing the quantity of nails or fasteners that are used to secure the roof covers on the roof ridge. This further provides a significant reduction in the number of locations where water can protrude into the roof of a house or building.

It is an object of the invention to provide a roof ridge cover to be fabricated with bend radius using fillets and rounds to ensure that the base material is not stretched beyond the yield point of the material where it can rupture or split. A fine balance must be maintained to ensure that the bends and forming radius both cover any existing shingles while simulating the appearance of shingles. If the ridge cover is too long the length can be cut down or shortened using existing tools that are used by roofing installers.

It is an object of the invention to provide a roof ridge cover for the edges of the cover to wrap around any existing roof tiles. The wrapping edges must be sufficient to cover any damaged tiles and provide sufficient clearance of adjacent or abutting ridge covers. The wrap edges must also be short enough to prevent the ridge cover to dig into other shingles or be raised above the surrounding area.

It is an object of the invention to provide a roof cover to be configurable for installation on hips, gables and rakes as well as 90 degree "L" shapes. The roof ridge cover is not affected by climate nor have climate restrictions for installation.

It is another object of the invention to provide a roof ridge cover having a top surface that is stone coated. The stone coating provides an appearance nearly identical to the remainder of the roof surface. The stone coatings provide surface protection, wear resistance and provide a gripping surface for installers or others that may walk on the roof surface.

It is still another object of the invention to provide a roof ridge cover available with a vent material that is bonded to the underside of the roof ridge cover. The vent material is sufficiently porous to allow air to vent from the attic thereby allowing the attic to breath, but the vent material must also be sufficiently dense enough to prevent insects and bugs from passing through the vent material. The vent material may be glued, set or otherwise placed as one or two strips along the length of the roof ridge cover, and optionally at the ends of the roof ridge cover to reduce the amount of force that is required to firmly anchor the roof ridge cover onto the roof ridge.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
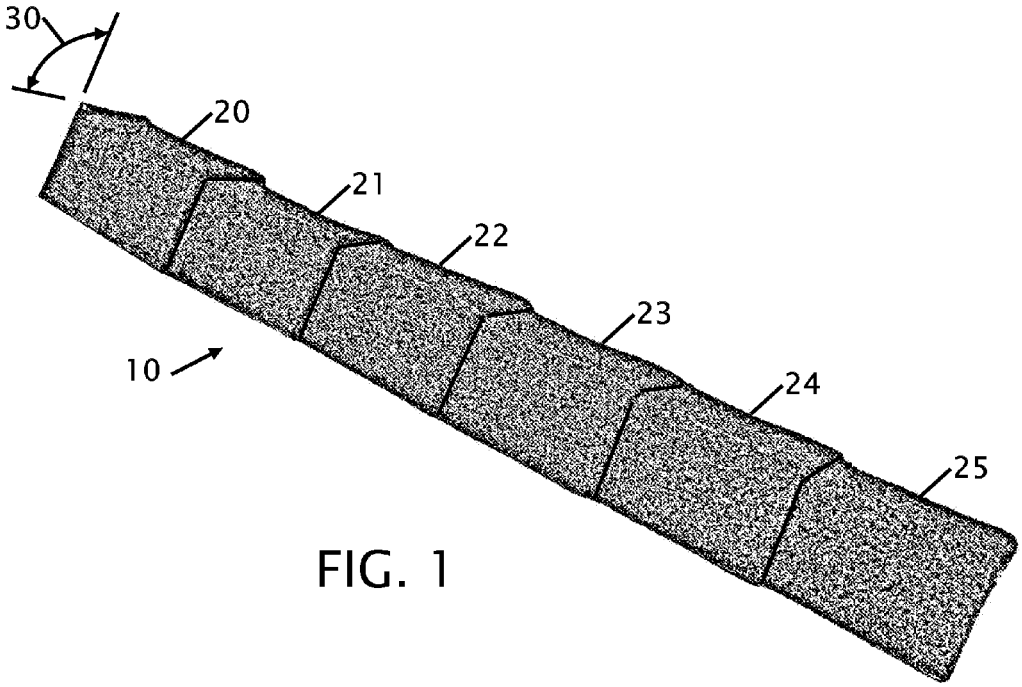
FIG. 1 shows a perspective view of a roof ridge cover.
Figure 2:
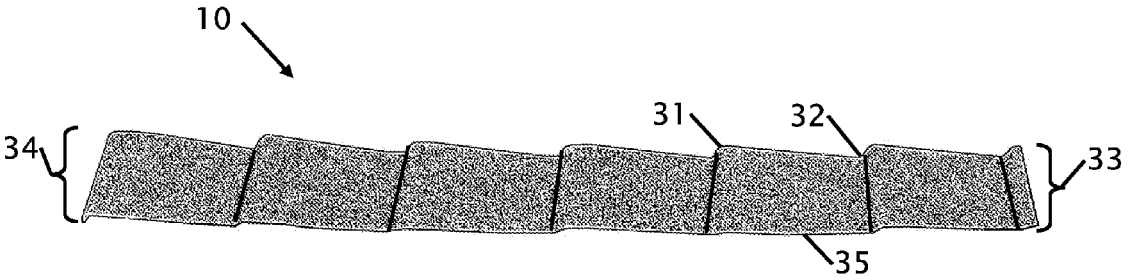
FIG. 2 shows a side view of the roof ridge cover.

FIG. 1 shows a perspective view of a roof ridge cover and FIG. 2 shows a side view of the roof ridge cover 10. The roof ridge cover 10 is fabricated to simulate the appearance of multiple ridge shingles. The steps between shingles is normally about 8 inches, but typically can vary between seven (7) and twelve (12) inches. The preferred embodiment shown represents steps of six levels 20-25 of ridge tiles. While six levels are shown it should be understood that as few as two to many more than six levels are contemplated in accord with the teaching herein. In the embodiment shown, six levels are shown because it best accommodates a four foot long blank and allows easy handling by an installer. If the end of the roof ridge cover 10 extends beyond the end of a roof, the roof ridge cover 10 can be trimmed using common roofing tools.

The angle 30 between the two sloped sides of the roof ridge cover 10 is configured to match the angle of a selected roof peak ridge. The angle is between 30 degrees and 120 degrees, but can be other angles. It is also contemplated that the cover is configurable for installation on hips, gables and rakes as well as 30 degree to 90 degree "L" shapes. The fabrication process for a roof ridge cover allows an installer to adjust this angle by nailing down the roof ridge cover 10 or manually distorting the roof ridge cover 10 to fit a complementary angle provided by an existing roof ridge. The coverage of multiple pre-existing roof tiles or shingles minimizes areas where water intrusion can take place. The bends of the roof ridge cover 10 shown as rounds 31 and fillets 32 are designed to simulate the appearance of the underlying tiles and also prevent ripping the material that might cause holes. In the preferred embodiment the rounds 31 and fillets 32 are between 0.12 inch radius and 1.0 inch radius. In addition to the bends that clear the underlying shingles the leading edge 34 and the trailing edge 33 are radiused to wrap around the front and back edges to the roof ridge cover 10. Adjacent roof ridge cover 10 ends 33 and 34 engage upon the turned up edges 33 or turned down edges 34 to make a tight seal. The bottom edge 35 can be configured in a straight embodiment or can further be rounded to wrap around existing ridge tiles to prevent leakage. The dimension(s) of the radiused edges are maintained to prevent damage to flat roof tiles and reduce the elevation of the roof ridge cover 10 above the surrounding roof. Installation of the roof ridge cover 10 on a roof is shown in FIG. 3.

Figure 3:
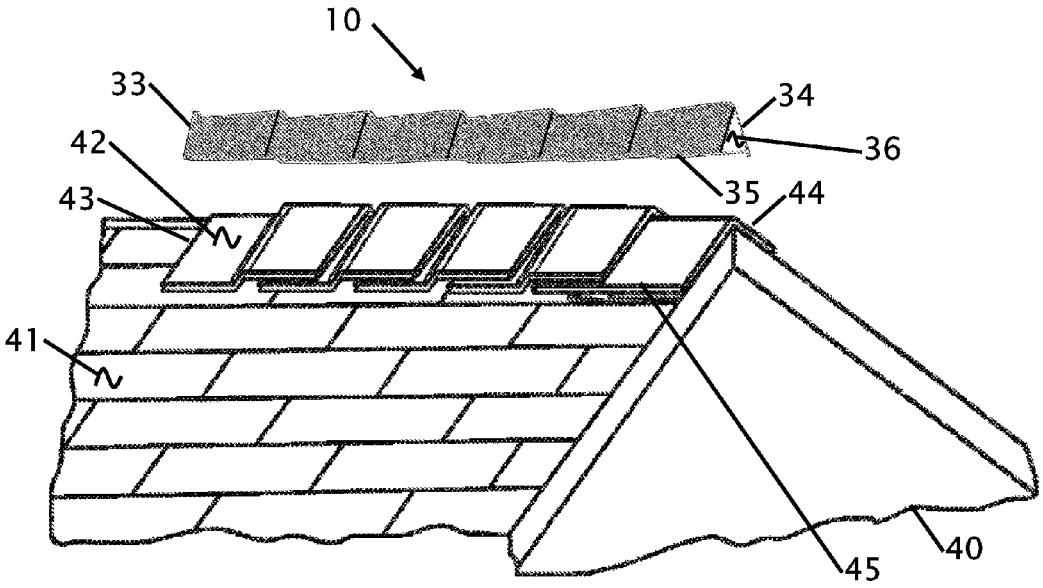
FIG. 3 shows a perspective view of a roof ridge cover positioned over a roof.

FIG. 3 shows a perspective view of a roof ridge cover 10 positioned over a roof. The roof of a house 40 is typically constructed with a peak where the two sloped sides of the roof 41 join. The ridge of the roof is most susceptible to leaks because it often receives the greatest exposure to the elements, e.g., the sun, wind and rain. The roof ridge cover 10 can be installed in newly installed roofs having newly installed shingles, or can be installed over the top of pre-existing roof ridge shingles 42. When the roof ridge cover 10 is installed on a pre-existing roof ridge shingle 42, the under surface 36 contacts the opposing sloped sides of the pre-existing roof shingle 42, the under surface 36 contacts the opposing sloped sides of the pre-existing roof shingles 42. The leading edge 34 wraps over and on the sides 35 of the pre-existing roof ridge single 42 leading edge 44 and side(s) 45. The roof ridge cover 10, has a second rounded edge 33 that wraps around at least partially at least one pre-existing roof ridge shingle 42/43 of the existing roof. When the roof ridge cover 10 is installed on the ridge, the leading edge 34 is installed over the outer edge of the ridge to enable water to drop over the edge of the roof. The trailing or upturned edge 33 will be covered by the next roof ridge cover 10. Upon installation of the roof ridge cover 10 the elongated sides of the roof ridge cover 10 are nailed down to prevent the roof ridge cover 10 from being lifted by winds and to retain underlying shingles.

Figure 4:
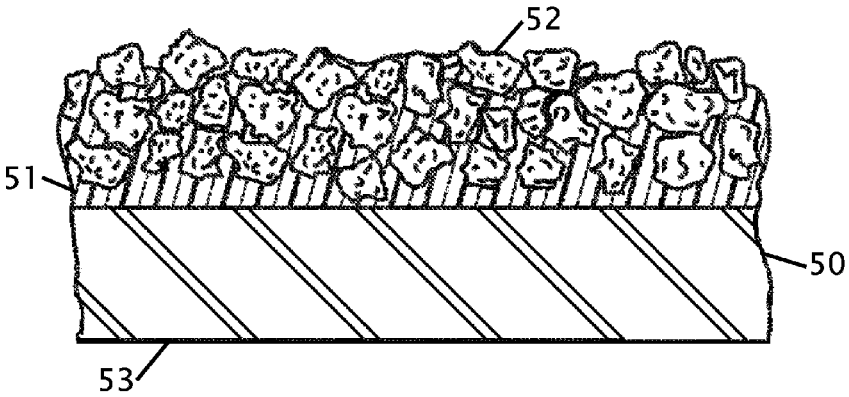
FIG. 4 shows a cross sectional view of the construction of the roof ridge cover.

FIG. 4 shows a cross sectional view of a method for a manufacture of an embodiment for the roof ridge cover. The roof ridge cover is constructed starting a base material, namely base metal 50. In the preferred embodiment the base metal 50 is steel, but other materials, particularly including, but not limited to stainless steel, aluminum, copper or tin may be utilized. The base metal 50 is then formed to simulate shingles. The forming process can take place in a progressive arrangement where each tile structure, elevation or relief is formed individually or collectively. It is also contemplated that the base metal 50 is first bent along its length to form the inverted "V" ridge and then in a secondary or subsequent operation(s) then each tile structure, elevation or relief is formed individually or collectively. While the figures show the cover as an inverted "V" it is also contemplated that the cover may be configures having a shape adapted for installation on hips, gables and rakes as well as 90 degree "L" shapes. A bonding agent 51 may then be applied to the base metal 50 to support a top stone 52 coat that matches the color, density and texture of the roof shingles on the roof of a house or structure. The materials used in the stone coating are typically between the size of sand to pea gravel depending upon the desired appearance and or the appearance of an existing roof material. The bonding agent is typically a nontoxic, non-flammable, re-emulsifying bonding agent that provides a chemical bond between the base material 50 and the top stone(s) 52. A surface treatment of galvanizing 53 or other corrosion prevention can be placed on the base metal 50 prior to applying the top treatments or after the top treatments based upon the manufacturing process. The roof ridge cover is not affected by climate nor has and does not have any climate restrictions for installation.

Figure 5:
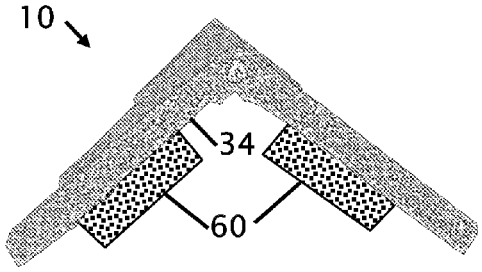
FIG. 5 shows a front view of the roof ridge cover with vent material installed.
Figure 6:
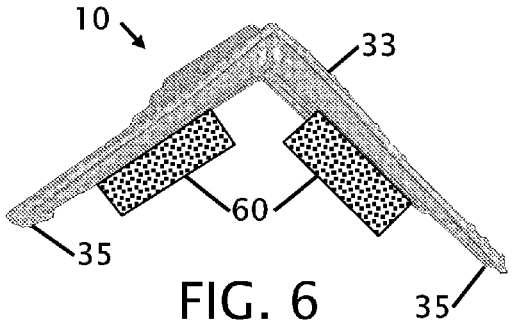
FIG. 6 shows a back view of the roof ridge cover with vent material installed.
Figure 7:
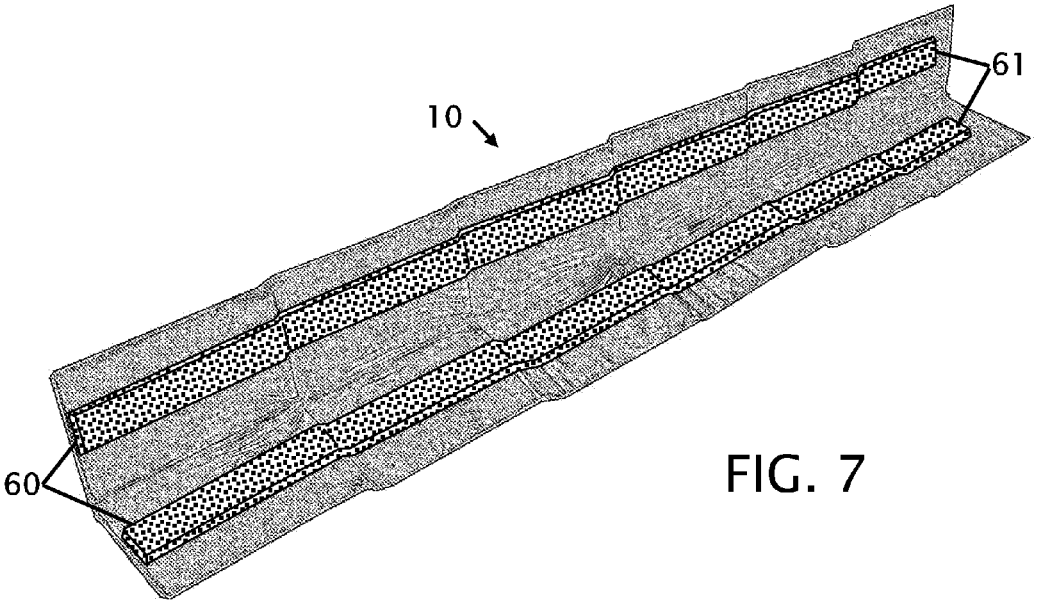
FIG. 7 shows an inside perspective view of the roof ridge cover with vent material installed.

FIG. 5 shows a front view of the roof ridge cover 10 with vent material 60 installed. FIG. 6 shows a back view of the roof ridge cover 10 with vent material 60 installed. FIG. 7 shows an inside perspective view of the roof ridge cover with vent material 60 installed. The roof ridge cover 10 can be constructed with vent material 60. The vent material 60 may be glued, or bonded to the roof ridge cover 10. Or, vent material 60 may simply be placed under the roof ridge cover 10 upon installation of the roof ridge cover 10. As depicted in FIG. 7, the vent material 60 is placed at the front edge of the leading edge 34 of the roof ridge cover 10, while the vent material 60 is set back from the trailing edge 33 to prevent stacking of the vent material 60. The vent material 60 may be installed in elongated strips to minimize interference with other roof features that can exist under the roof ridge cover 10. The density of the vent material 60 allows for the attic to breathe and vent air without allowing bugs and insects to enter the attic. As depicted in FIG. 5 and FIG. 6, the outer edges 35 of the roof ridge cover 10 are slightly curved.

Figure 8:
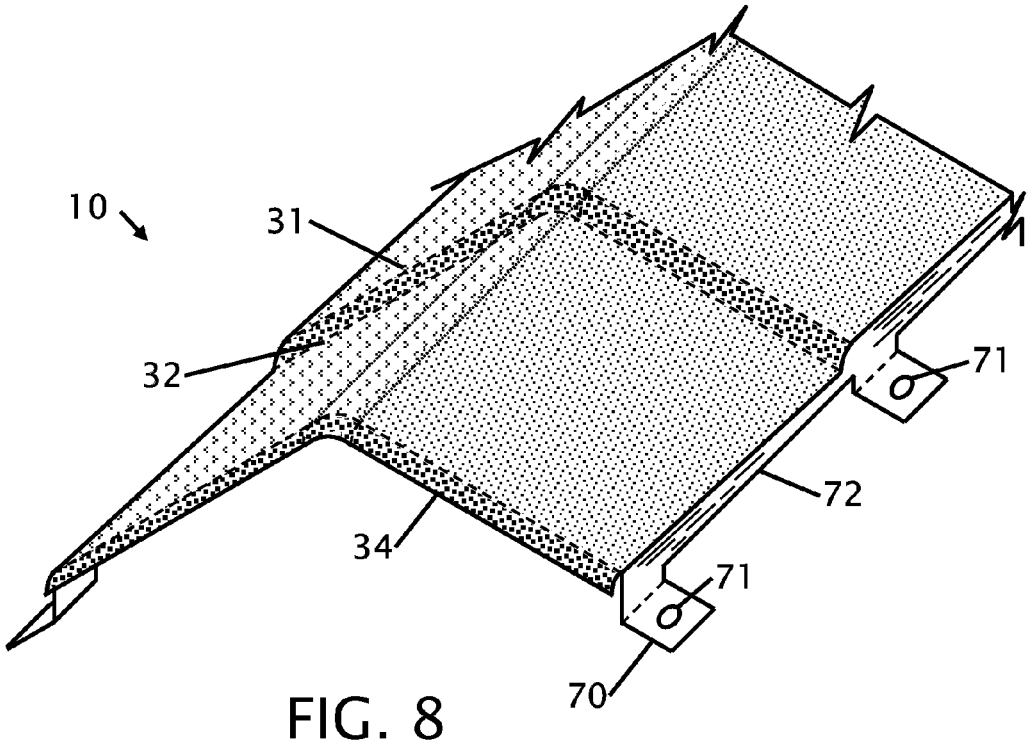
FIG. 8 shows a perspective view of a section of roof ridge cover with tabs for securing the roof ridge cover.

FIG. 8 shows a perspective view of a section of roof ridge cover 10 with tabs for securing the roof ridge cover 10. The front edge 34 is shown bent over to cover an existing shingle or a previously installed roof ridge cover. The rounds 31 and fillets 32 are shown and may be provided at an interval of approximately 8 inches. Nailing tabs 70 are shown with holes 71 or indentations where nails can be placed through the flanges 70. An air gap 72 is constructed into the roof ridge cover 10 to allow for the passage of air from under the roof. When the tabs 70 are included in the roof ridge cover 10 the blank size must be expanded from 12 inches to approximately 14.5 inches.

Thus, specific embodiments of a roof ridge cover have been disclosed. It should be apparent, however, to those skilled in the art that many more modifications besides those described are possible without departing from the inventive concepts herein. The inventive subject matter, therefore, is not to be restricted as defined by the scope and coverage of the appended claims, and their legal equivalents.

The invention claimed is:

1. A roof ridge cover comprising:

an elongated base formed to give an appearance of multiple ridge cover shingles, said elongated base having an outer surface and an under surface;

said elongated base formed in an inverted "V" shape having an angle that approximate an angle provided by opposing sides at a ridge of an existing roof, said elongated base shaped to provide the appearance of multiple shingles with at least two generally planar parallel shingle surfaces and a step surface existing between each pair of said at least two generally planar parallel shingle surfaces on both sides of said inverted "V";

said outer surface providing a cosmetic surface, and said under surface having at least two separate integral tabs formed from the elongated base form that are adapted for contact with opposing sloped sides of said ridge of said roof;

said elongated base comprising at least two rounded edges with at least one first rounded edge being a leading edge and at least one second rounded edge being a trailing edge;

said at least two separate integral tabs formed from opposing elongated sides of said elongated base and extending from each side of said opposing elongated sides to create an air gap between said existing roof and said under surface of said elongated base, said separate integral tabs having an integral nailing tab whereby said integral nailing tab elevates said outer surface and said integral nailing tab is nailed directly onto said existing roof;

said elongated base further comprising a coating, said coating providing the appearance of multiple ridge cover shingles, and said at least one second rounded edge configured so that, when said roof ridge cover is installed, said at least one second rounded edge is adapted to cover a trailing edge of a previously installed roof ridge cover that goes over a third roof ridge cover.

2. The roof ridge cover according to claim 1 wherein said coating is a stone coating on said outer surface.

3. The roof ridge cover according to claim 1 wherein said at least two rounded corners are formed with a radius from between 0.12 and 1.0 inch radius.

4. The roof ridge cover according to claim 1 further including at least one vent placed on said under surface.

5. The roof ridge cover according to claim 1 wherein said at least two tabs provide a space for a vent material.

6. The roof ridge cover according to claim 1 wherein said elongated base comprises a metal selected from a group consisting of steel, stainless steel, aluminum, tin, brass and copper.

7. The roof ridge cover according to claim 1 wherein each of the planar parallel shingle surfaces in said elongated base is provided to appear as a single shingle.

8. The roof ridge cover according to claim 1 wherein the appearance of multiple shingles is formed in a single forming process.

9. The roof ridge cover according to claim 8, wherein the forming of each essentially planar parallel shingle surface and each said step surface are formed in progressive single forming processes.

10. The roof ridge cover according to claim 1 wherein said elongated base is galvanized.

11. The roof ridge cover according to claim 1 wherein the step surface between the at least two generally planar parallel shingle surfaces is spaced every 7 to 12 inches.

12. The roof ridge cover according to claim 1 wherein said elongated base has a width of between 12 inches and 14.5 inches.

13. The roof ridge cover according to claim 1 wherein said coating comprises a nontoxic, non-flammable, re-emulsifying bonding agent.

14. The roof ridge cover according to claim 1 wherein said coating comprises a stone coating including sand or pea gravel.

15. The roof ridge cover according to claim 1 wherein there are at least four generally planar parallel shingle surfaces and at least three separate step surfaces.

16. The roof ridge cover according to claim 1 wherein said leading edge of said elongated base is turned down and said trailing edge of said elongated base is turned up.

17. The roof ridge cover according to claim 1 wherein the elongated base includes at least three step surfaces.

* * * * *